US006734833B1

(12) United States Patent
Bartosik

(10) Patent No.: US 6,734,833 B1
(45) Date of Patent: May 11, 2004

(54) DYNAMIC ILLUMINATED DISPLAY

(76) Inventor: Dennis M. Bartosik, 1044 Endeavor Ct., Nokomis, FL (US) 34275

( * ) Notice: Subject to any disclaimer, the term of this patent is extended or adjusted under 35 U.S.C. 154(b) by 0 days.

(21) Appl. No.: 09/702,977

(22) Filed: Oct. 31, 2000

Related U.S. Application Data

(60) Provisional application No. 60/165,945, filed on Nov. 17, 1999.

(51) Int. Cl.[7] ..... G09G 5/00

(52) U.S. Cl. ..... 345/4; 345/903; 273/387; 463/58

(58) Field of Search ..... 345/46, 4, 1.1, 345/903; 273/371, 349, 387; 340/815.4, 815.5, 815; 362/184; 40/430, 506; 463/60, 58

(56) References Cited

U.S. PATENT DOCUMENTS

| | | | | |
|---|---|---|---|---|
| 836,681 | A | | 11/1906 | Gilman |
| 1,392,764 | A | | 10/1921 | Higuchi |
| 1,441,404 | A | | 1/1923 | Czerny |
| 1,499,875 | A | | 7/1924 | Rosenheim |
| 1,518,754 | A | | 12/1924 | Prina et al. |
| 1,533,795 | A | | 4/1925 | Foans |
| 1,749,689 | A | | 3/1930 | Baum |
| 2,034,324 | A | | 3/1936 | Brady |
| 2,732,210 | A | | 1/1956 | Heide |
| 2,759,731 | A | | 8/1956 | Quinn |
| 3,336,030 | A | | 8/1967 | Martell et al. |
| 3,411,783 | A | | 11/1968 | Montagna |
| 3,434,717 | A | | 3/1969 | Schwartz |
| 3,572,712 | A | | 3/1971 | Vick |
| 3,645,529 | A | | 2/1972 | Andrews |
| 3,781,011 | A | | 12/1973 | Barlow |
| 4,578,672 | A | * | 3/1986 | Oota et al. ..... 345/88 |
| 4,773,863 | A | | 9/1988 | Douglas, III |
| 5,118,320 | A | | 6/1992 | Miller |
| 5,411,269 | A | | 5/1995 | Thomas |
| 5,439,230 | A | * | 8/1995 | Mendes, Jr. ..... 273/349 |
| 5,573,243 | A | | 11/1996 | Bartosik |
| 5,823,849 | A | | 10/1998 | Gardner et al. |
| 6,007,429 | A | * | 12/1999 | Lubniewski ..... 273/371 |
| 6,095,526 | A | * | 8/2000 | Cook, II ..... 273/349 |
| 6,265,984 | B1 | * | 7/2001 | Molinaroli ..... 340/815.4 |

* cited by examiner

*Primary Examiner*—Dennis-Doon Chow
(74) *Attorney, Agent, or Firm*—Frijouf, Rost & Pyle, P.A.

(57) ABSTRACT

An improved dynamic illuminated display is disclosed comprising a plurality of display segments with each of the display segments having a multiplicity of illuminated display elements disposed thereon. A plurality of the plurality of display segments are interconnected to form a longitudinal extending array. A controller is connected to each of the multiplicity of illuminated display elements of the longitudinally extending array. An input is connected to the controller for providing an input signal to the controller for activating selected ones of the multiplicity of illuminated display elements in a desired sequence for providing a dynamic display to the longitudinally extending array. The improved dynamic illuminated display is suitable for use with amusement devices such as competitive games or the like.

6 Claims, 14 Drawing Sheets

DYNAMIC ILLUMINATED DISPLAY

CROSS-REFERENCE TO RELATED APPLICATIONS

This application claims benefit of U.S. Patent Provisional application serial No. 60/165,945 filed Nov. 17, 1999. All subject matter set forth in provisional application serial No. 60/165,945 is hereby incorporated by reference into the present application as if fully set forth herein.

BACKGROUND OF THE INVENTION

1. Field of the Invention

This invention relates to illuminated displays and more particularly to an improved dynamic illuminated display capable of visually displaying illuminated information and or illuminated text information.

2. Background of the Invention

The prior art has known various types of displays for attracting attention and/or conveying information to a viewer. In some cases, the prior art used mechanical displays while other cases in the prior art used illuminated displays.

Others in the prior art have used dynamic mechanical displays for attracting attention and or conveying information to the viewer. These dynamic mechanical displays incorporated a linear or rotationally moving display for providing a visual output to a viewer. In many cases, these dynamic mechanical displays were three dimensional displays.

Displays have been widely used in the field of amusement devices such as amusement games, and in particular to a competitive arcade game and the like. These competitive arcade games include water driven competitive games for providing a competition for a multiplicity of participants.

U.S. Pat. No. 836,681 to Gilman discloses a game apparatus with the combination of an object mounted to move progressively step by step along a track. A target is connected to an object by which the former controls the progressive step-by-step movement of the latter along the track.

U.S. Pat. No. 1,392,764 to Higuchi discloses an element to be propelled over a course of travel. The element controlling the speed of the propelling means includes a hand operated pneumatic pouch and a power transmitting pneumatic pouch for conveying air from one pneumatic pouch to the other.

U.S. Pat. No. 1,441,404 to Czemy discloses an amusement device including a track having two inclined portions and interconnecting portions. One of the inclined portions has a loop therein. A platform supports the inclined portions. A vehicle is adapted to ride on the track-way. The vehicle is held in position for descent on the inclined track-way having the loop portion. The trip being a target member connecting the target and trip, whereby when the target is moved the trip releases the vehicle.

U.S. Pat. No. 1,499,875 to Rosenheim discloses a race game apparatus comprising a plurality of individual raceway water tanks. Each tank contains a dirigible float being formed with a fixed start-location at one end and a signal device at the other adapted to be controlled by a player for directing air under pressure against the dirigible float.

U.S. Pat. No. 1,518,754 to Prina et al. discloses an amusement device with a corresponding plurality of actuators for players pertaining to the respective series of indicator devices. Connections between the indicator devices and the actuators successively indicated several series will be made manifest in accordance with the actuation of the actuators serving to cause all other indicator devices to become idle when a certain one of the indicator devices of one of the series is made manifest.

U.S. Pat. No. 1,533,795 to Foans discloses a game combination with a platform with a carriage arranged thereon. A target carried by the carriage operated by the position of the target for propelling the carriage.

U.S. Pat. No. 1,749,689 to Baum discloses a target having a horizontal row of apertures adjacent the upper edge. A target swingably mounted on the edge of the support and in vertical alignment with each of the apertures. The target having a downwardly extended portion passing through its associated aperture. The portion having upon its reverse side a numerical value, adapted to be displayed upon rearward swinging movement of the target.

U.S. Pat. No. 2,034,324 to Brady discloses a movable figure for driving the figure for starting and stopping the driving. A target device controlling the starting and stopping. The starting and stopping means being movable by the figure to a stopping position and by the target device to a starting position.

U.S. Pat. No. 2,732,210 to Heide discloses a game apparatus which may be played by a single player or by a plurality of players. A plurality of horses each carried at one end of a movable element from a starting position in horizontal planes parallel with respect to each other to a finish position in the planes. Electrically actuated means for advancing the movable elements and the horses step by step in the planes. An operating circuit for the electrically actuated means including a ball-actuated switch and a starting switch. A circuit having a coin actuated switch therein for conditioning the operating circuit for operation. The ball-actuated switch cooperates with the remaining switches of the operating circuit for conditioning a sprint circuit for energizing the electrically actuated advancing means independently of the operating circuit. A reset coil in the operating circuit for returning the horses to a starting position in the planes. The reset coil being in circuit with a holding switch and energized by the coin actuated switch for returning the horses to a starting position. The circuit holding switch and the reset coil deenergized by an arm carried by each of the horses when the horses return to the starting position. The finish position in the planes coupled with the operating circuit for deenergizing the operating circuit when one of the horses reaches the finish position by the actuation of the operating circuit. The last-named means including a normally open switch adjacent to the finish position in the planes so as to be closed by the arm carried by the first of the horses to reach the finish position.

U.S. Pat. No. 2,759,731 to Quinn discloses a competitive game apparatus of aligned vertical tubes closed at their lower ends and open at their upper ends. Each of the tubes are provided with a water outlet near its lower end and a water intake near its upper end. The water intakes are arranged to form a series of spaced targets. A float is reciprocally mounted in each of the tubes. A shooting line spaced from the tubes and a series of water guns are arranged on the shooting line in positions corresponding to the targets. A delivering of water under pressure to the guns, whereby water may be directed into the intake opening and cause the float to be projected through the top of the tube denoting a competitive winner.

U.S. Pat. No. 3,336,030 to Martell et al. discloses a gun system for playing a game comprising a fragile hollow inflatable indicating the progress and finish of the game. Fluid pressure means connected by way of fluid connections to the inflatable object for producing fluid pressure to inflate the object. A valve for the inflatable object being connected in the fluid connection. A gun spaced from the target means for actuating the target when the gun is correctly aimed by a player at the target. An actuator connected to the target and to the valve to open the valve to allow fluid to inflate the inflatable indicator means only when the target is actuated.

U.S. Pat. No. 3,411,783 to Montagna discloses a miniature racing track assembly for electrically operated toy vehicles. A pair of side by side tracks each of which has first and second portions in longitudinal alignment and in the same horizontal plane. A Y-shaped member connects the respective first and second portions with the end portions of helically shaped track loops.

U.S. Pat. No. 3,434,717 to Schwartz discloses a water gun target including a water receiving and collecting means, a target of foamed plastic material having at least one planar face having apertures therein, the panel being of such construction so as to emit a distinct sound when struck by a stream of water. There is a target means disposed in at least some of the apertures and a water deflector means behind the target and extending beyond the edges of the target to deflect the water into the water receiving and collecting means.

U.S. Pat. No. 3,572,712 to Vick discloses an oscillating water-gun target enclosing a mercury switch which, when struck by a stream of water from a water gun, completes a circuit to a drive motor for moving an animated indicator along a vertical track with the circuit being interrupted upon failure of the water stream to strike the switch means and including a cutoff switch actuated by the indicator when it reaches the top of the track.

U.S. Pat. No. 3,645,529 to Andrews discloses a game device of chance and skill wherein electrically conductive game pieces are propelled in electrically contacting relationship between two facing horizontal conductive game board surfaces. One of the game board surfaces is electrically segmented into a plurality of conductive terminals which are electrically related to lights on a display board so that as a game piece moves between the game board surfaces, a visual display is presented on the display board to indicate the relative position of the game piece on the game board.

U.S. Pat. No. 3,781,011 to Barlow discloses an electromechanical racing game, having figures mounted for linear movement across the length of a game board with each of the figures being connected to motors for driving them along the game board. Intermittently actuatable switch means is provided for intermittently driving the motors to propel each of the figures, with pin ball devices in the form of launching plungers and game balls arranged for launching towards said intermittent switch means so that, if properly launched, the pin balls will be deposited on a switch element which will close said switch means to intermittently drive said motor to advance a related figure along the game board.

U.S. Pat. No. 4,773,863 to Douglas, III discloses an amusement device for a toilet bowl or a urinal comprising a urine detector for detecting a urine flow from a human and for providing an electrical signal for activating a sensory stimulus device. A control unit connected to the urine detector converts the electrical signal to a signal for activating the appropriate indicator. In one embodiment of the invention, a plurality of pressure and temperature sensors are imbedded in a plastic base which is disposed in close proximity to the urinal or toilet bowl drain. Disposed alongside each temperature and pressure sensor is an associated LED lamp or buzzer which is activated by that sensor. The device may be connected to a video screen or a speaker disposed above the urinal for providing additional audio and visual stimulation to the user. In another embodiment, a plastic base is disposed entirely within the toilet bowl or urinal in close proximity to the toilet or urinal drain. A plurality of supports extend upward from the base and terminate in a corresponding plurality of rotatable members horizontally connected to the supports for rotating in response to a urine flow from a human.

U.S. Pat. No. 5,118,320 to Miller discloses a roller coaster or gravity motive toy having a tortuous elevated track layout and toy vehicle system including adjustable support stanchions for the track attached thereto by a universal joint. The vehicle includes rollers movably supporting the vehicle on the track with pivotal roller guide and lateral securement elements to detachably couple the vehicle to the track. An articulated figure or caricature is carried in the vehicle having pivotal extremities adapted for centrifugal actuation during travel of the vehicle. A motorized lift is operably carried on the track selectively engaging with a vehicle lifting the vehicle to an elevated starting position for gravity operation.

U.S. Pat. No. 5,411,269 to Thomas discloses a Water-gun Target Game and Apparatus in which a direct-current electrical water-presence detector, supported by or worn on an outer garment, is the bull's eye. A hit by the water jet initiates action by a direct electrical effect, such as a resistance change, ordering responses by switching, sound or visual signaling, and scoring devices. A water-level sensor option initiates a steady signal after a succession of hits or a strong continuous hit. A single shunt option can be used t prevent false triggering. An absorption option disposes of received water, allowing repetitious operation. A tank for the water level sensor has a discharge stopper, which when removed, opens a power source circuit and inhibits any response. The object of the game is to project the jet stream of the water gun on to the target, making one or repetitious hits on the apparatus-bearer's bull's-eye. Counter-circuitry provides digital visual scoring.

U.S. Pat. No. 5,439,230 to Mendes, Jr. discloses a game in which two or more players compete to fill a column of water by engaging a target with a fluid or solid projectile stream or a light beam. Detectors upon a target are adapted to signal a separate water pressure device in order to force water from a reservoir up into and through a transparent or translucent column. At the top of such column a detector awaits the rising column of water in order to signal its arrival and indicate the success of the player in engaging his or her respective target. The apparatus can be configured so that each player's column is filled from a separate reservoir or from a common reservoir.

U.S. Pat. No. 5,823,849 to Gardner et al. discloses a toy that can sense contact with a fluid. The toy preferably contains a conductive member and an adjacent conductive screen. An indicator circuit has one terminal connected to the conductive member and another terminal connected to the conductive screen. The screen and conductive member are in relative close proximity so a fluid which flows through the screen will provide an electrically conductive path between the two conductive members. The conductive path closes the indicator circuit. The indicator circuit has an audio unit and/or light source that are activated when the circuit is closed by the fluid. The conductive members can be attached to a shield which also has a spray device. A player can spray another player with the spray device of the shield. The player can also block the spray of an opposing player with the shield. If the fluid makes contact with the conductive members the indicator circuit provides and indication that a "hit" has occurred. A player must therefore expose himself to a possible hit when attempting to spray another player. The toy may have a counter which shuts off the spray device if the player has been hit a certain number of times.

In my prior U.S. Pat. No. 5,573,243, I disclosed a novel water activated rotatable column game system for fun and amusement and prizes. The system comprises a game housing having an open rear face and open side faces and an enclosed top roof and an enclosed bottom floor and an open front face for the people to participate and observe the progress of the game. A plurality of rotatable columns and figurines are disposed within the game housing in an upstanding parallel orientation, each rotatable column being dedicated to travel rotatably from a start line to a finish bumper. A plurality of game consoles are disposed adjacent to the game housing and control the rotatable columns. A plurality of motor means are disposed in the game housing. Each motor means is electrically coupled to one rotatable column for moving the rotatable column. Each console has a switch means disposed therein and further being in an electric circuit therebetween one of the consoles and one of the rotatable columns for moving the rotatable column when in a closed status and halting the rotatable column when in an open status. A second plurality of switch means are disposed in the game housing at each finish bumper and further being in electric circuit communication therebetween each motor means for illuminating the winning finish bumper.

It is a primary object of the present invention to improve my prior U.S. Pat. No. 5,573,243 by eliminating the need for mechanical movement of the targets and/or mechanical movement of the display devices.

Another object of this invention is to provide an improved dynamic illuminated display which may provide either status of the game in visual and/or in text message form.

Another object of this invention is to provide an improved dynamic illuminated display capable of pictorial displays.

Another object of this invention is to provide an improved dynamic illuminated display which simulates the movement of the target or the status display by a sequence of illuminating selective elements of a display.

Another object of this invention is to provide an improved dynamic illuminated display which is more reliable and lowers the overall cost than the displays of the prior art.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

A specific embodiment of the present invention is shown in the attached drawings. For the purpose of summarizing the invention, the invention relates to an improved dynamic illuminated display comprising a plurality of display segments. Each of the display segments has a multiplicity of illuminated display elements disposed thereon. The plurality of display segments are connected to form a longitudinal extending array. A controller is connected to each of the multiplicity of illuminated display elements of the longitudinally extending array. An input is connected to the controller for providing an input signal to the controller for activating selected ones of the multiplicity of illuminated display elements in a desired sequence for providing a dynamic display to the longitudinally extending array.

In one example of the invention, a plurality of spacers interconnect the plurality of display segments to form a longitudinal extending array. In another example of the invention, plurality of electrical connectors interconnect the plurality of display segments to form a longitudinal extending array.

In a more specific embodiment of the invention, each of the display segments is disposed within a plane. The multiplicity of illuminated display elements are disposed about an outer periphery of the display segment for providing 360 degree illumination within the plane. In this example of the invention, each of the display segments is a substantially circular disk with the multiplicity of illuminated display elements being disposed about a circumference of the circular disk. Each of the multiplicity of illuminated display elements may comprise a solid state illumination device such as a light emitting diode or the like.

In another specific embodiment of the invention, each of the display segments is disposed within a plane disposed along the longitudinal extending array. The multiplicity of illuminated display elements are disposed for providing 360 degree illumination along the plane. In this example of the invention, each of the display segments is a substantially linear display segment with the multiplicity of illuminated display elements being disposed along the substantially linear display segment. Each of the multiplicity of illuminated display elements may comprise a solid state illumination device such as a light emitting diode or the like In one embodiment of the invention, the plurality of display segments to form a longitudinal extending array extending along a straight line. In another example of the invention, the plurality of display segments to form a longitudinal extending array extending along a curved line. A transparent tube may be disposed about the longitudinally extending array.

In another embodiment of the invention, the controller comprises a master control and a plurality of control portions. Each of the plurality of control portions is disposed on each of the plurality of display segments, respectively. Each of the plurality of control portions control the multiplicity of illuminated display elements disposed on the respective display segment. A connector connects the master control to the plurality of control portions for providing input signals to the plurality of control portions for activating the selected ones of the multiplicity of illuminated display elements.

The input may include memory means for storing a plurality of input control sequences to the controller. The controller serially selects different ones of the plurality of input control sequences from the memory means for providing the dynamic illuminated display such as a moving graphic pattern or a moving text display. The controller selects at least one of the plurality of input control sequences from the memory means in response to an external signal from a competitive game for providing the dynamic illuminated display to indicate the progress of the competitive game.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several views of the drawings.

DETAILED DISCUSSION

Figure 1:
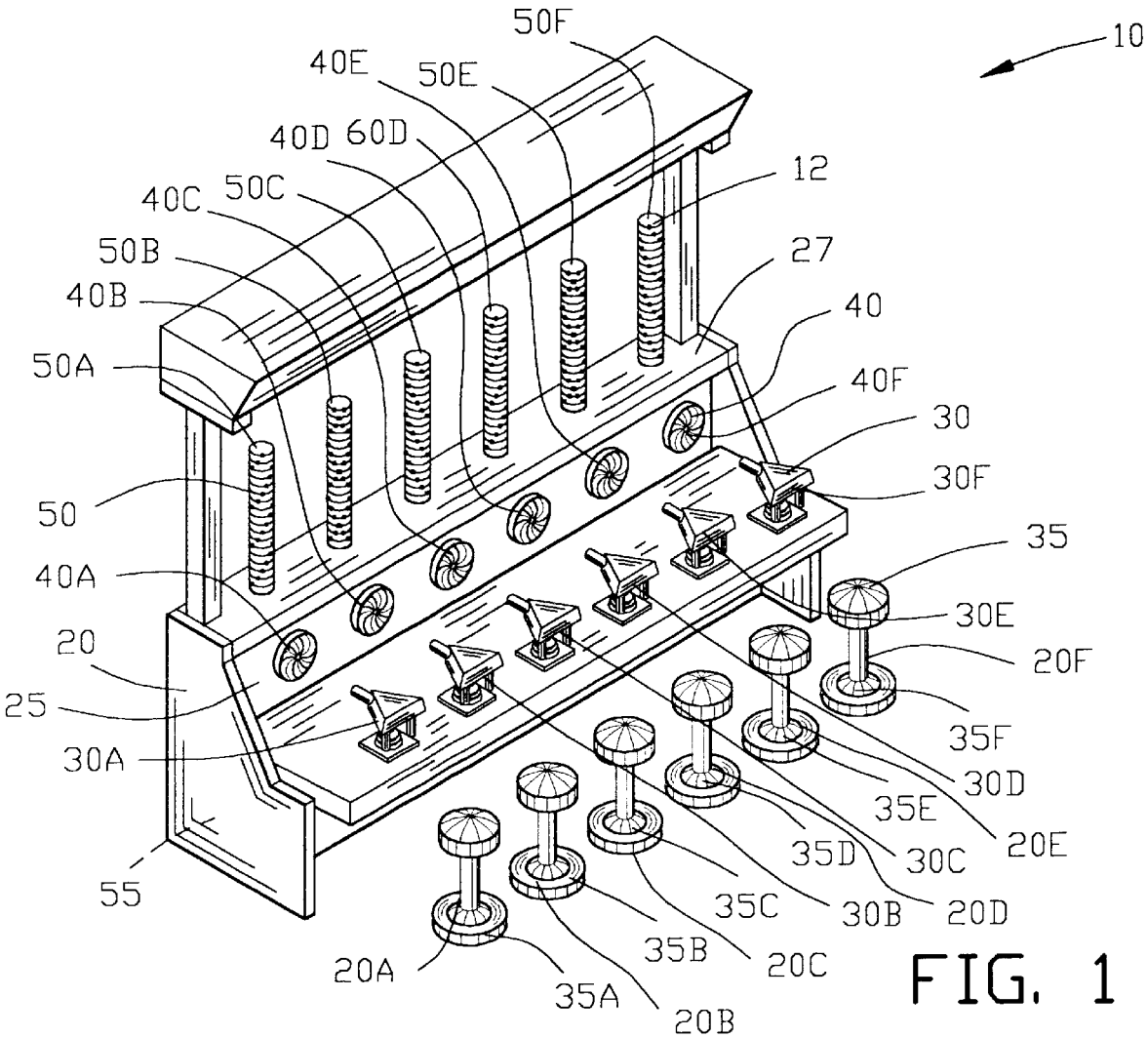
FIG. 1 is an isometric view of the improved dynamic illuminated display of the present invention incorporated into a competitive game.

FIGS. 1–4 illustrate various views of an improved dynamic illuminated display 10 incorporated into an amusement game 20. In this embodiment of the invention, the improved dynamic illuminated display 10 is incorporated into an illuminated target display 11 and an illuminated longitudinally extending display 12.

Although the dynamic illuminated display 10 is incorporated into an amusement game 20, it should be understood that the improved dynamic illumination display 10 may be associated with virtually any type of device and that the amusement game 20 has been shown merely for purposes of example.

The amusement game 20 comprises a plurality of game consoles 20A–20F having frame surfaces 25 and 27. Each of the game consoles 20A–20F comprises a projecting device 30A–30F for each of a plurality of contestants. Each of the projecting devices 30A–30F is capable of projecting a projectile toward a plurality of targets 40A–40F. The projectiles may take the form of a physical projectile such as a ball, bullet, a water stream or any other suitable type of projectile. In the alternative, the projectiles may take the form of non-physical projectiles such as a light beam, an acoustical wave, or the like. In this example of the amusement game 20, the plurality of projecting devices 30A–30F are pressurized water guns for the contestant to aim and to project streams of water at the plurality of targets 40A–40F.

The projecting devices 30A–30F are aimed at the respective plurality of targets 40A–40F by the plurality of contestants in a competitive manner. In the amusement games 20 of the prior art, the plurality of targets devices 40A–40F had target indicia thereon. Each of the game consoles 20A–20F may comprise optional stools 35A–35F for the comfort of the contestants.

The plurality of targets 40A–40F provide an area of impact for projectiles. Each of the plurality of targets comprises a display area 42A–42F and a bulls-eye area 44A–44F. As will be described in greater detail hereinafter, the bulls-eye areas 44A–44F are provided with sensors for sensing the impact of the projectiles emanating from the projecting devices 30A–30F.

Each of the game consoles 20A–20F comprises a plurality of display devices 50A–50F for indicating the progress and the winner of the amusement game 20. In the amusement games 20 of the prior art, the plurality of display devices 50A–50F were figurines mechanically elevated in accordance with the progress of the amusement game 20 as shown in my prior U.S. Pat. No. 5,573,243. A controller 55 is connected to the plurality of projecting devices 30A–30F and the plurality of targets 40A–40F and the plurality of display devices 50A–50F for controlling the operation thereof.

Figure 5:
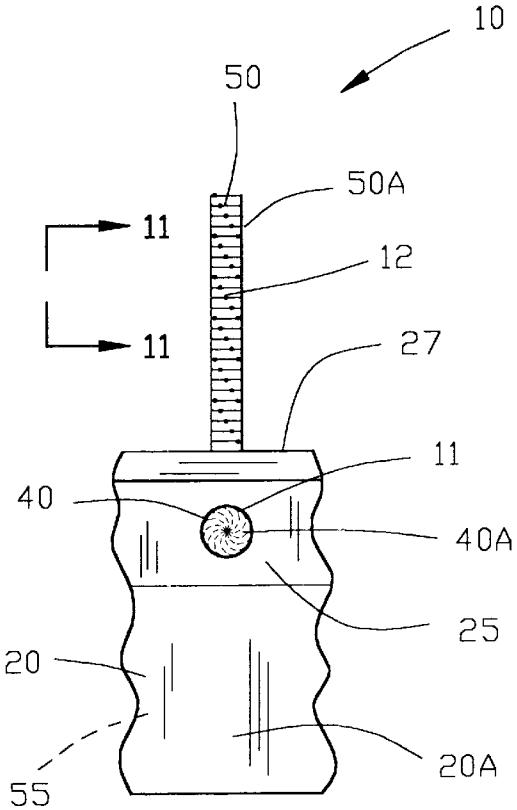
FIG. 5 is a sectional view along line 5—5 in FIG. 4 illustrating an illuminated target display and an illuminated longitudinally extending display.
Figure 4:
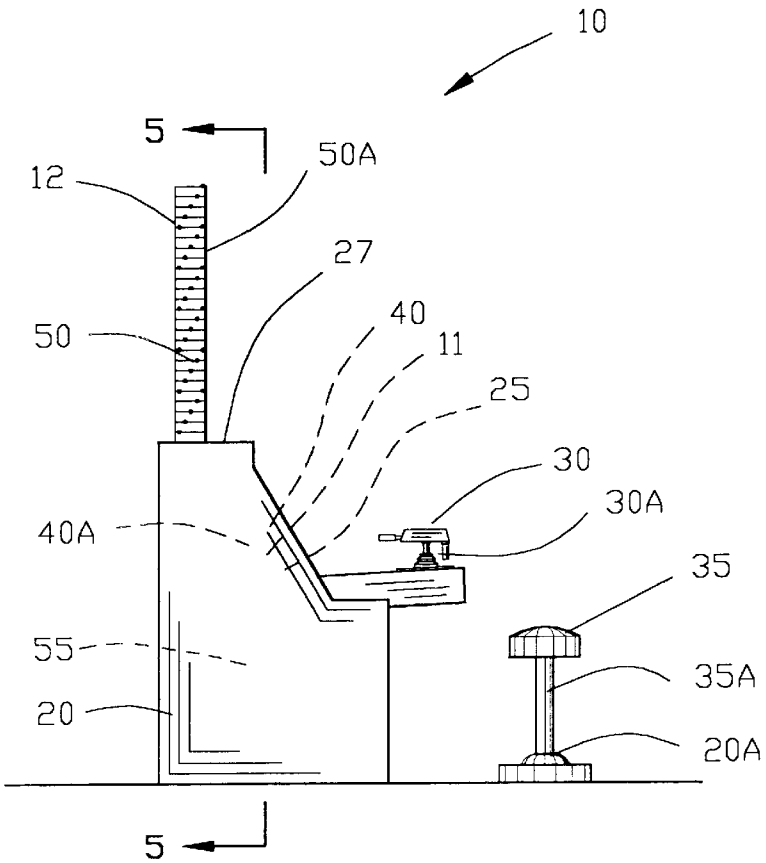
FIG. 4 is a left side view of FIG. 1 with an outer support being removed with the right side view being a mirror image thereof.

FIG. 5 is a sectional view along line 5—5 in FIG. 4 illustrating the projection device 30A and the target 40A. The improved dynamic illuminated display 10 is shown as the illuminated target display 11 incorporated into the target 40A and the illuminated longitudinally extending display 12 incorporated into the display devices 50A–50F. The illuminated target display 11 and the illuminated longitudinally extending display 12 incorporate dynamic illuminated displays for eliminating the need for mechanical movement of the illuminated target display 11 and the illuminated longitudinally extending display 12.

Figure 8:
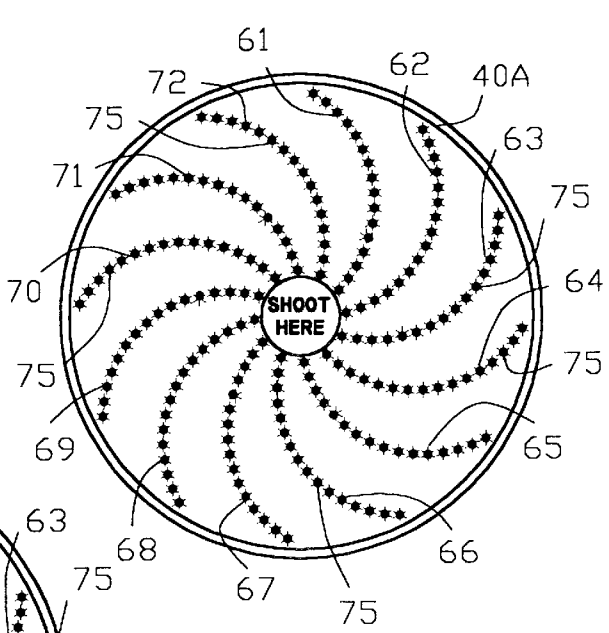
FIG. 8 is a magnified view of the illuminated target display of FIG. 5 in a third illumination sequence.
Figure 7:
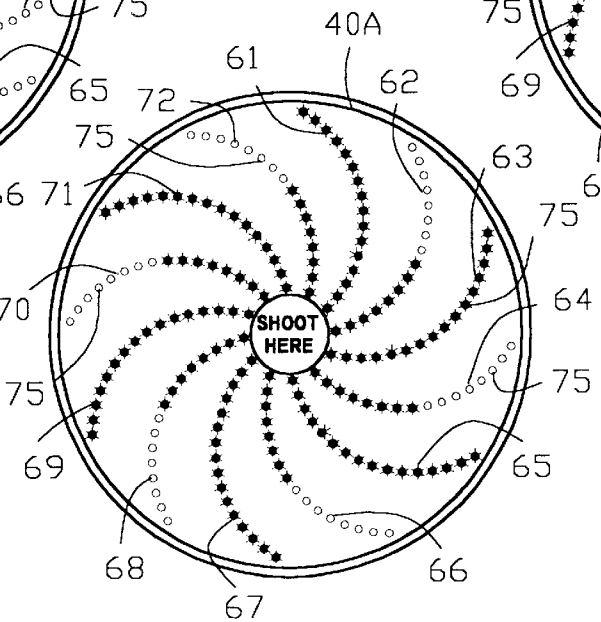
FIG. 7 is a magnified view of the illuminated target display FIG. 5 in a second illumination sequence.
Figure 6:
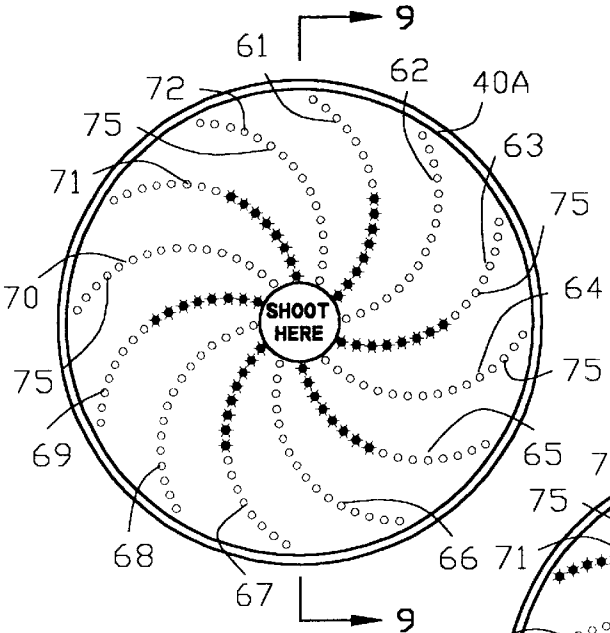
FIG. 6 is a magnified view of the illuminated target display of FIG. 5 in a first illumination sequence.

FIGS. 6–8 are magnified views of the illuminated target display 11 of FIG. 5 in various illumination sequences. The target 40A comprises a circular target plate 42 having an opening 44 defined in the center of the circular target plate 42. The opening 44 is adapted to receive the projectile emanating from the projecting devices 30A–30F.

The illuminated target display 11 comprises a plurality of display segments 61–72 disposed about the opening 44 defined in the center of the circular target plate 42. Each of the display segments has a multiplicity of illuminated display elements 75 disposed thereon. The controller 55 is connected to each of the multiplicity of illuminated display elements 85 for activating the multiplicity of illuminated display elements 85 in accordance with a desired sequence.

FIGS. 6–8 illustrate the illumination of the target display 11 as a first, second and third sequence of illumination. The rapid sequence of illumination of the target display 11 as shown in FIGS. 6–8 generates the visual perception of movement to the contestants. The number of visual perceptions of movement generated by the rapid sequence of illumination of the target display 11 is virtually unlimited.

Figure 9:
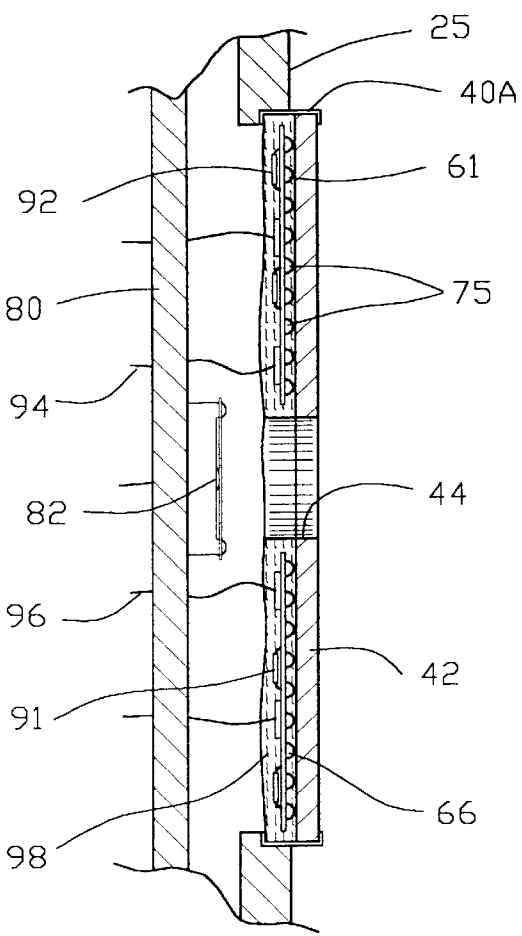
FIG. 9 is a side sectional view of a target of FIGS. 1–8 without impact.

FIG. 9 is a side sectional view of the target 40A of FIGS. 1–8 without impact of a stream of water. The circular target plate 42 is supported by the frame surface 25. A backer plate 80 is supported behind the opening 44 defined in the center of the circular target plate 42. A pressure sensitive switch 82 is mounted on the backer plate 80 in registry with the opening 44 in the circular target plate 42.

Preferably, the circular target plate 42 is formed from a clear polymeric material. The illuminated target display 11 comprises a printed circuit board 90 mounting the multiplicity of illuminated display elements 75 to form the pattern of the plurality of display segments 61–72 disposed about the opening 44 in the center of the circular target plate 42. It should be appreciated by those skilled in the art that the specific pattern of the plurality of display segments 61–72 may be varied in accordance with the desired appearance of the illuminated target display 11.

The printed circuit board 90 may include electronic components 91 and 92 connected to the controller 55 by wires 94 and 96 in a conventional manner. In this embodiment in the invention, the printed circuit board 90 and the multiplicity of illuminated display elements 75 are encapsulated within a polymeric material 98. Preferably, the polymeric material 98 completely encapsulates the printed circuit board 90 and the multiplicity of illuminated display elements 75 and bonds to the circuit target played 42. The polymeric material 98 in combination with the polymeric circular target played 42 totally encloses the electronic components of the illuminated target display 11 making the display suitable for use with a water actuated amusement game 20.

Figure 10:
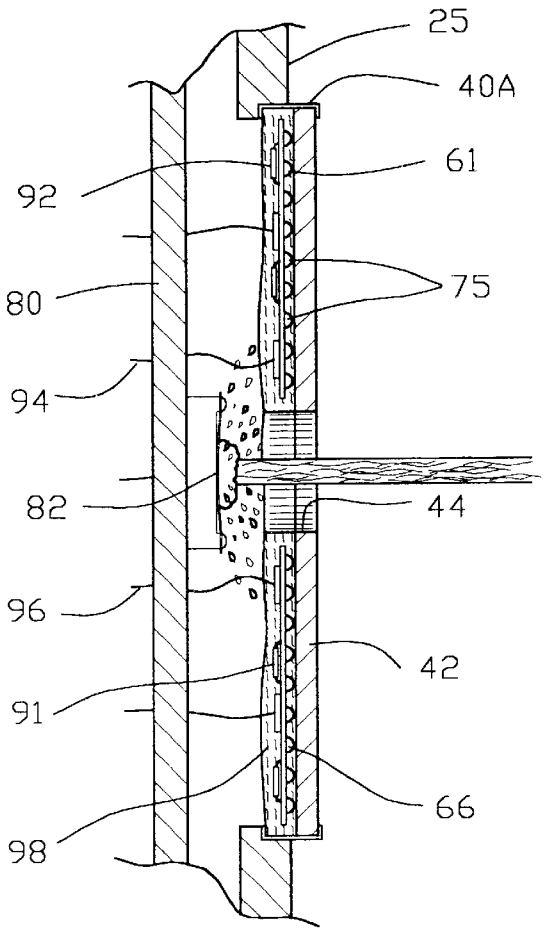
FIG. 10 is a view similar to FIG. 9 with the target under impact.

FIG. 10 is a view similar to FIG. 9 with the target 40A under impact from a pressurized stream of water. The pressurized stream of water impacts the pressure sensitive switch 82 for activating the controller 55. The controller 55 actuates the illuminated longitudinal extending display 12 as will be described in greater detail hereinafter.

Figure 11:
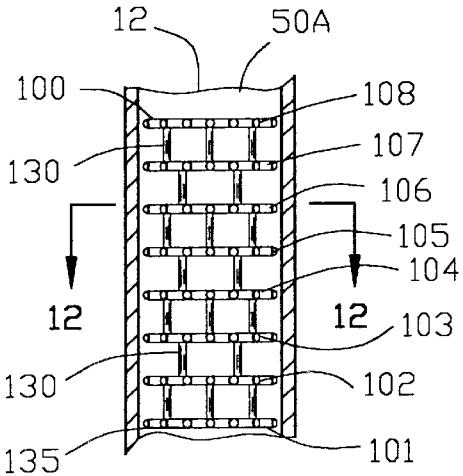
FIG. 11 is a magnified sectional view along line 11—11 in FIG. 5 illuminated longitudinally extending display.
Figure 12:
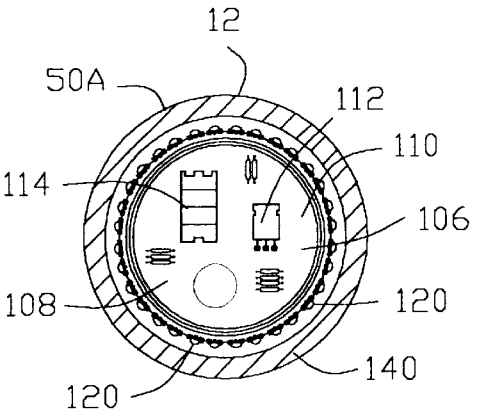
FIG. 12 is a sectional view along line 12—12 in FIG. 11.

FIGS. 11 and 12 are enlarged views of the illuminated longitudinal extending display 12 shown in FIGS. 1–5. The illuminated longitudinal extending display 12 comprises a plurality of display segments 100 shown as display segments 101–106. In this example of the invention, each of the display segments 100 is a substantially circular disk 108 shown as a planar circuit board 110. The printed circuit board 110 may include electronic components 112 and 114 connected to the controller 55.

A multiplicity of illuminated display elements 120 are disposed about a circumference of the planar circuit board 110 for providing 360 degree illumination along a plane of the circular disk 108. Preferably, each of the multiplicity of illuminated display elements 120 comprises a solid state illumination device such as light emitting diodes.

A plurality of spacers 130 interconnect the plurality of display segments 100 to form a longitudinal extending array 135 extending along a straight line as shown in FIGS. 11. In the alternative, the plurality of spacers 130 may interconnect the plurality of display segments to form a longitudinal extending array extending along a curved line.

The plurality of spacers 130 may be insulating spacers. In the alternative, the plurality of spacers 130 may be conductors for electrically interconnecting the plurality of display segments 100. In a further alternative, the plurality of spacers 130 may contain wires electrically interconnecting the plurality of display segments 100.

A transparent tube 140 is shown disposed about the longitudinally extending array 135. The transparent tube 140 provides multiple reflection of the light output from the illuminated display elements 120 to further enhance the illuminated display. In addition, the transparent tube 140 provides protection for the electronic components of the illuminated longitudinal extending display 12 making the display suitable for use with a water actuated amusement game 20. The ends of the transparent tube 140 may be sealed to provide total protection for the electronic components of the illuminated longitudinal extending display 12.

Figure 13:
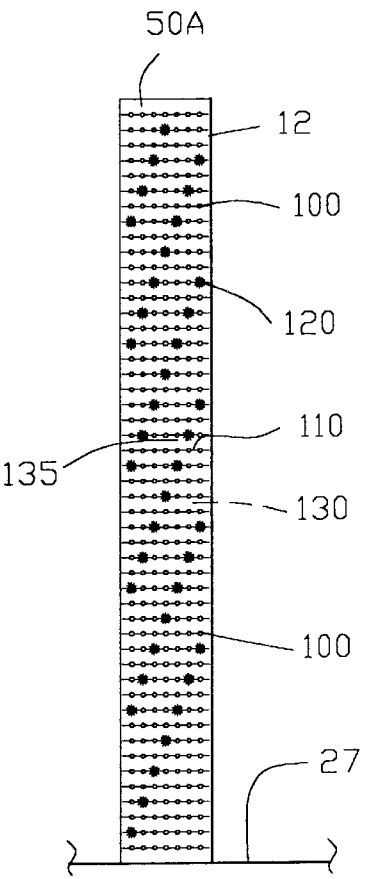
FIG. 13 is an enlarged view of a portion of FIG. 5 illustrating the illuminated longitudinally extending display in a first illumination sequence.

FIG. 13 is an enlarged view of a portion of FIG. 5 illustrating the illuminated longitudinally extending display 12 in a first illumination sequence. The first illumination sequence is shown as a plurality of parallel diagonal lines. When the plurality of parallel diagonal lines are moving, the first illumination sequence provides a swirling visual perception of movement to the contestants.

Figure 14:
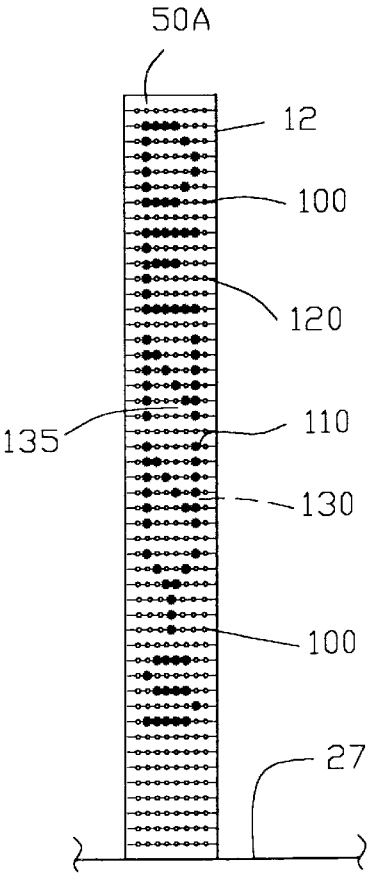
FIG. 14 is an enlarged view of a portion of FIG. 5 illustrating the illuminated longitudinally extending display in a second illumination sequence.

FIG. 14 is an enlarged view of a portion of FIG. 5 illustrating the illuminated longitudinally extending display 12 in a second illumination sequence. The second illumination sequence is shown as a text message. The text message may be a static or a moving text message.

Figure 2:
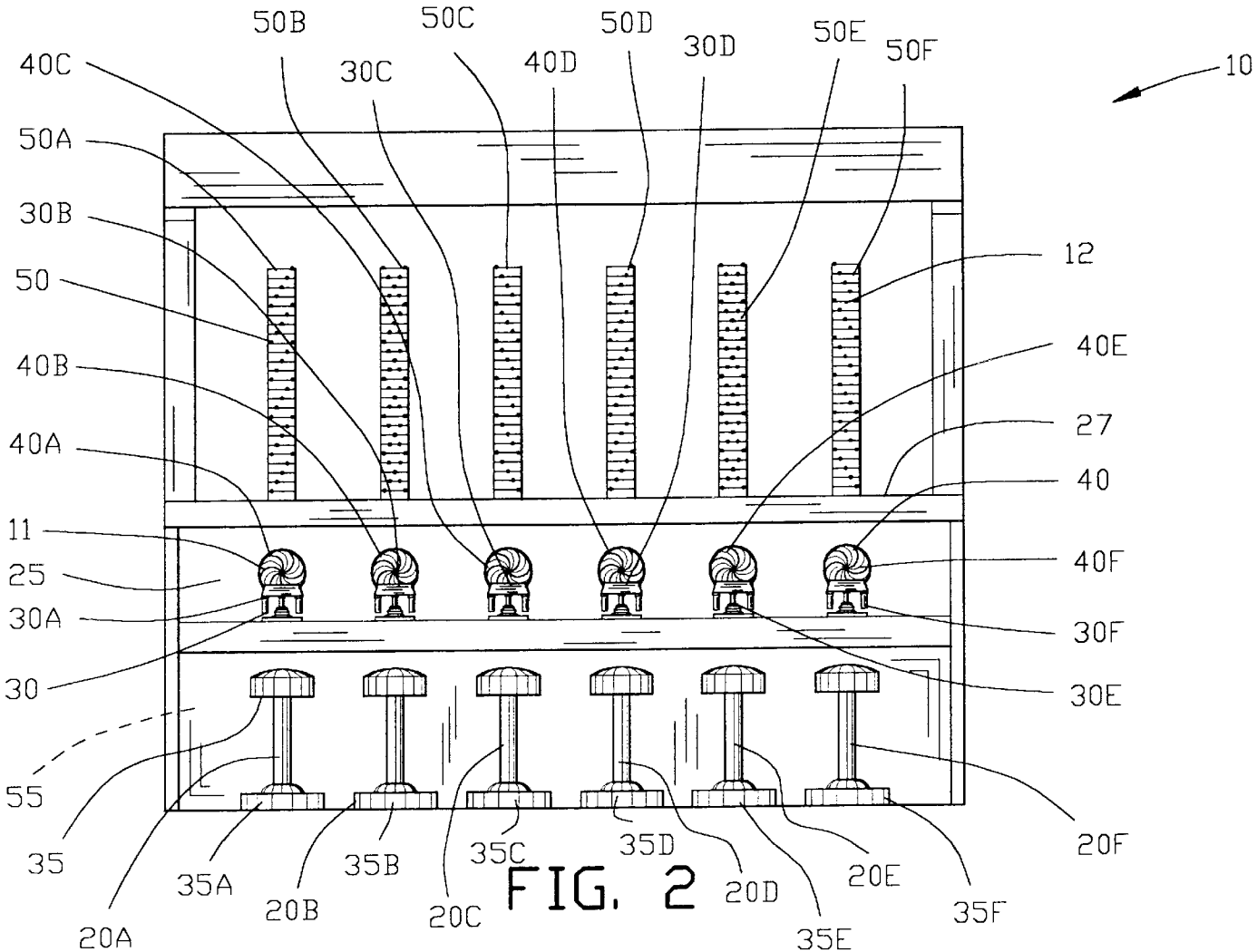
FIG. 2 is a front elevation view of the FIG. 1.
Figure 3:
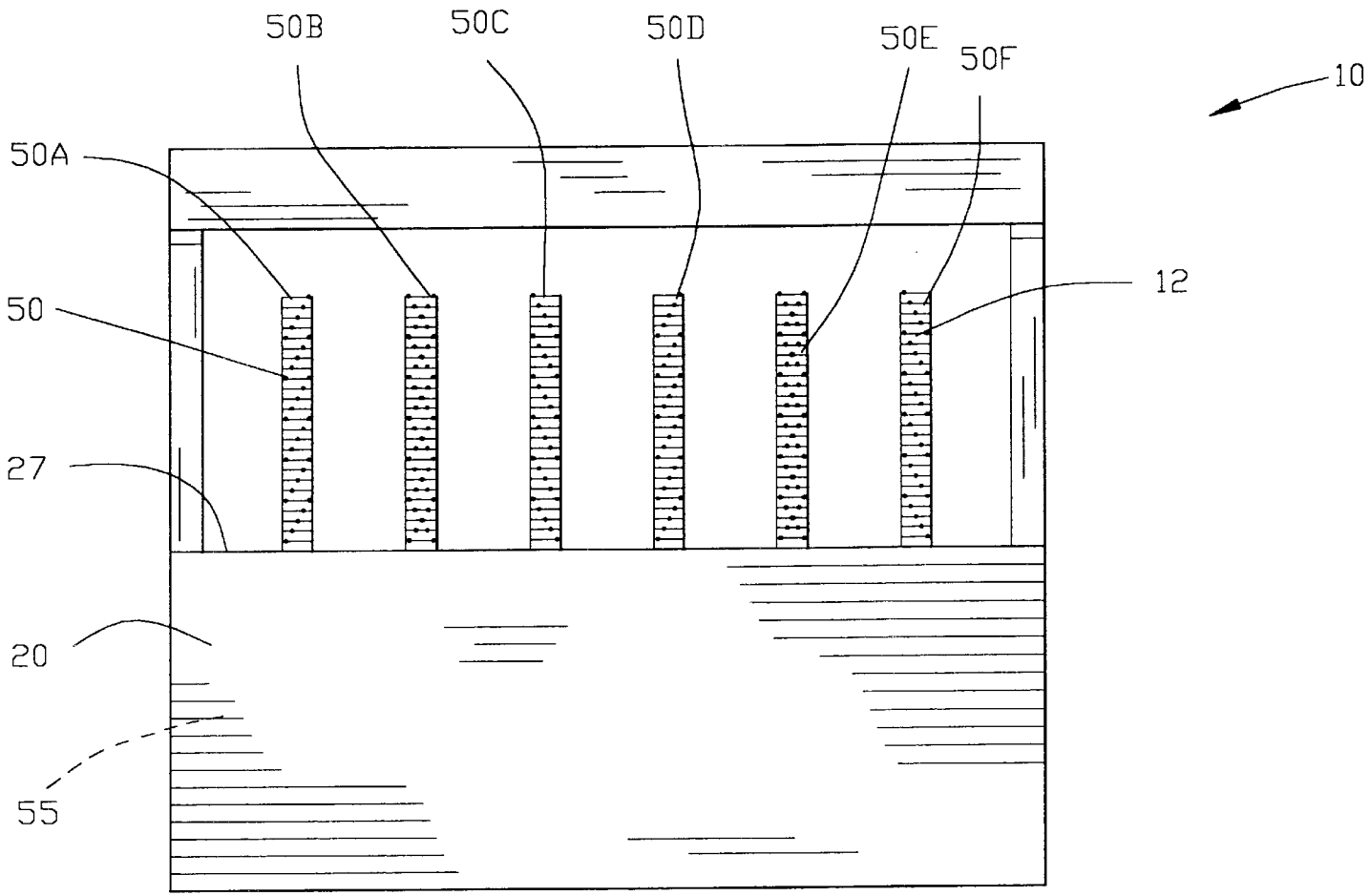
FIG. 3 is a rear elevation view of FIG. 1.
Figure 15:
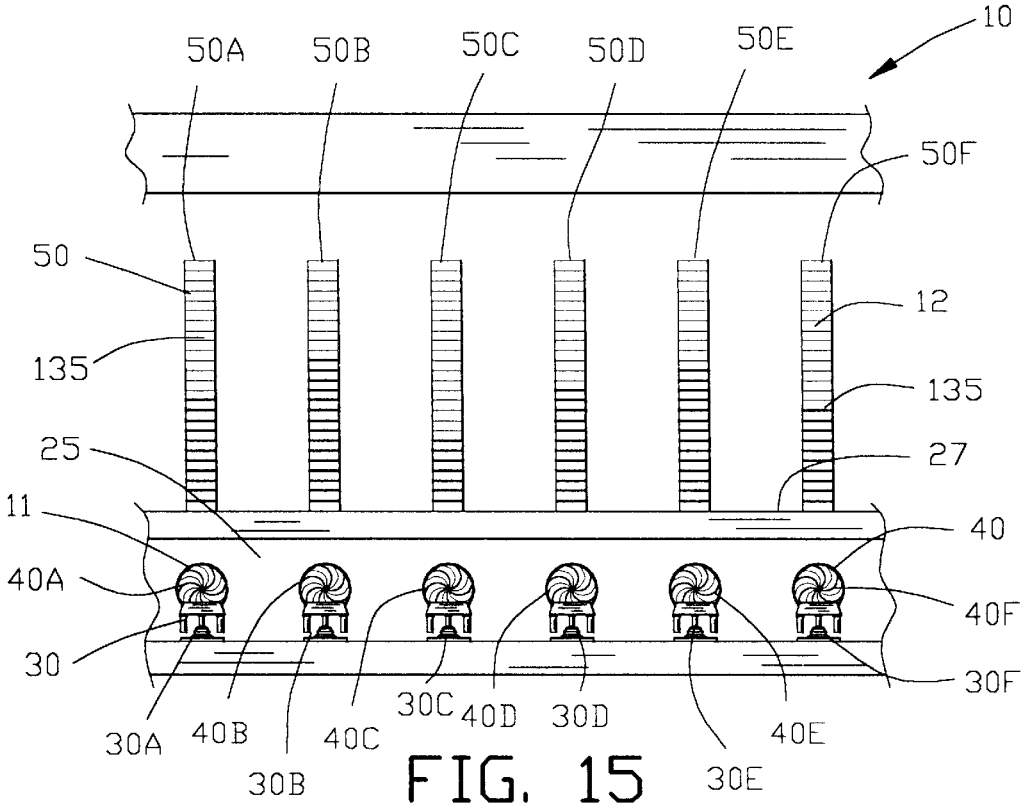
FIG. 15 is an expanded view of a portion of FIG. 2 illustrating a plurality of the illuminated longitudinally extending display in a first competitive illumination sequence.

FIG. 15 is an expanded view of a portion of FIG. 2 illustrating a plurality of the display devices 50A–50F each containing the illuminated longitudinally extending display 12. In this example, the plurality of the display devices 50A–50F illustrate a first competitive illumination sequence. The first competitive illumination sequence displays the progress of the competitive game and the instantaneous ranking of the contestants.

Figure 16:
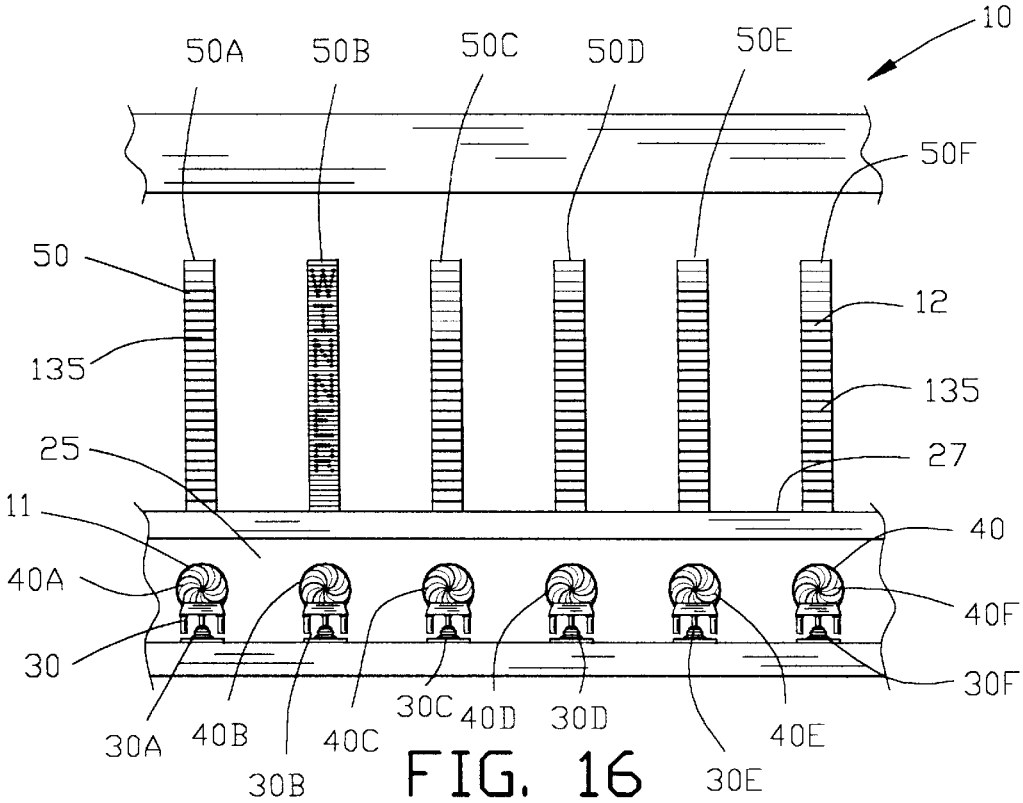
FIG. 16 is a view similar to FIG. 15 illustrating the plurality of the illuminated longitudinally extending display in a second competitive illumination sequence.

FIG. 16 is a view similar to FIG. 15 illustrating the plurality of the display devices 50A–50F in a second competitive illumination sequence. The second competitive illumination sequence displays the winner of the competitive game and the ranking of the other contestants.

A controller 55 is connected to each of the multiplicity of illuminated display elements 120 of the longitudinally extending array 135. An input from the pressure sensitive switch 82 is connected by connectors 94 and 96 to the controller 55 for providing an input signal to the controller 55. The controller 55 activates selected ones of the multiplicity of illuminated display elements 120 in a desired sequence for providing a dynamic display to the longitudinally extending array 135.

The controller 55 may comprise a master control and a plurality of control portions such as the electronic component 112 and 114 disposed on each of the plurality of display segments 100 as shown in FIG. 12. Each of the plurality of control portions such as the electronic component 112 and 114 control the multiplicity of illuminated display elements 120 disposed on the respective display segment 100. A connector connects the master control to the plurality of control portions for providing input signals to the plurality of control portions for activating the selected ones of the multiplicity of illuminated display elements.

The input includes memory means for storing a plurality of input control sequences to the controller 55. The controller 55 selects at least one of the plurality of input control sequences from the memory means for providing the dynamic illuminated display.

Figure 17:
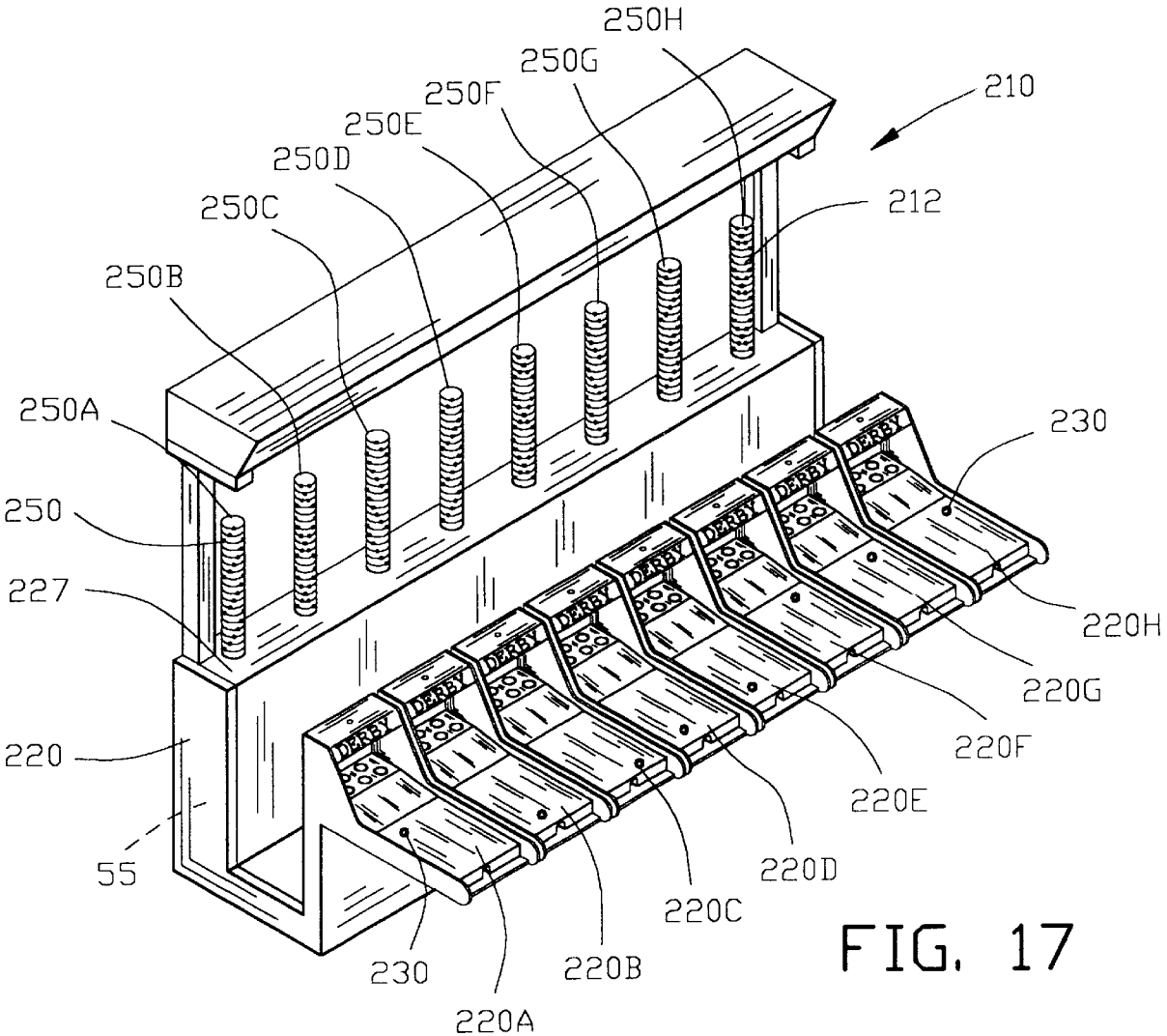
FIG. 17 illustrates a plurality of the illuminated longitudinally extending display incorporated into a second competitive game.

FIG. 17 illustrates a plurality of the illuminated longitudinally extending display 212 incorporated into a second amusement game 220. The second amusement game 220 comprises a plurality of game consoles 220A–220H having frame surfaces 225 and 227. In this amusement game 220, a plurality of free projectiles such as balls 230 are given to each of a plurality of contestants. Each of the projectiles 230 are thrown at a plurality of targets 240A–240H by the plurality of contestants in a competitive manner. The plurality of targets 240A–240H provide an area of impact for projectiles 230.

Each of the game consoles 220A–220H comprises a plurality of display devices 250A–250H for indicating the progress and the winner of the amusement game 220. Each of the plurality of display devices 250A–250H include the illuminated longitudinally extending display 212 of the present invention.

Figure 18:
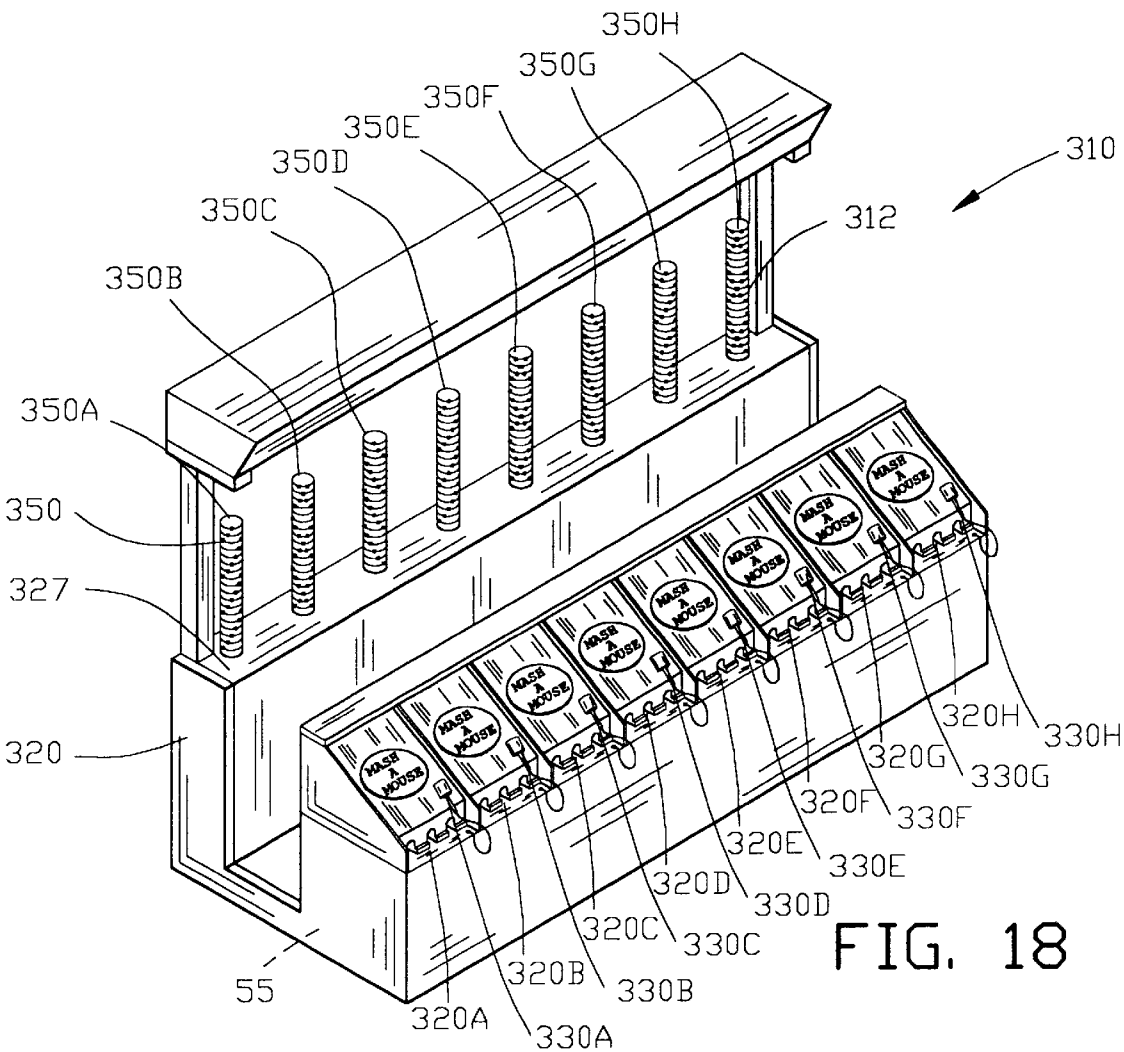
FIG. 18 illustrates a plurality of the illuminated longitudinally extending display incorporated into a third competitive game.

FIG. 18 illustrates a plurality of the illuminated longitudinally extending display incorporated into a third amusement game 320. The third amusement game 320 comprises a plurality of game consoles 320A–320H having frame surfaces 325 and 327. In this amusement game 320, a plurality of tethered projectiles shown as hammers 330A–330H are given to each of a plurality of contestants. Each of the projectiles 330A–330H are thrust at a plurality of targets 340A–340H by the plurality of contestants in a competitive manner. The plurality of targets 340A–340H provide an area of impact for projectiles 330A–330H.

Each of the game consoles 320A–320H comprises a plurality of display devices 350A–350H for indicating the progress and the winner of the amusement game 320. Each of the plurality of display devices 350A–350H include the illuminated longitudinally extending display 312 of the present invention.

Figure 19:
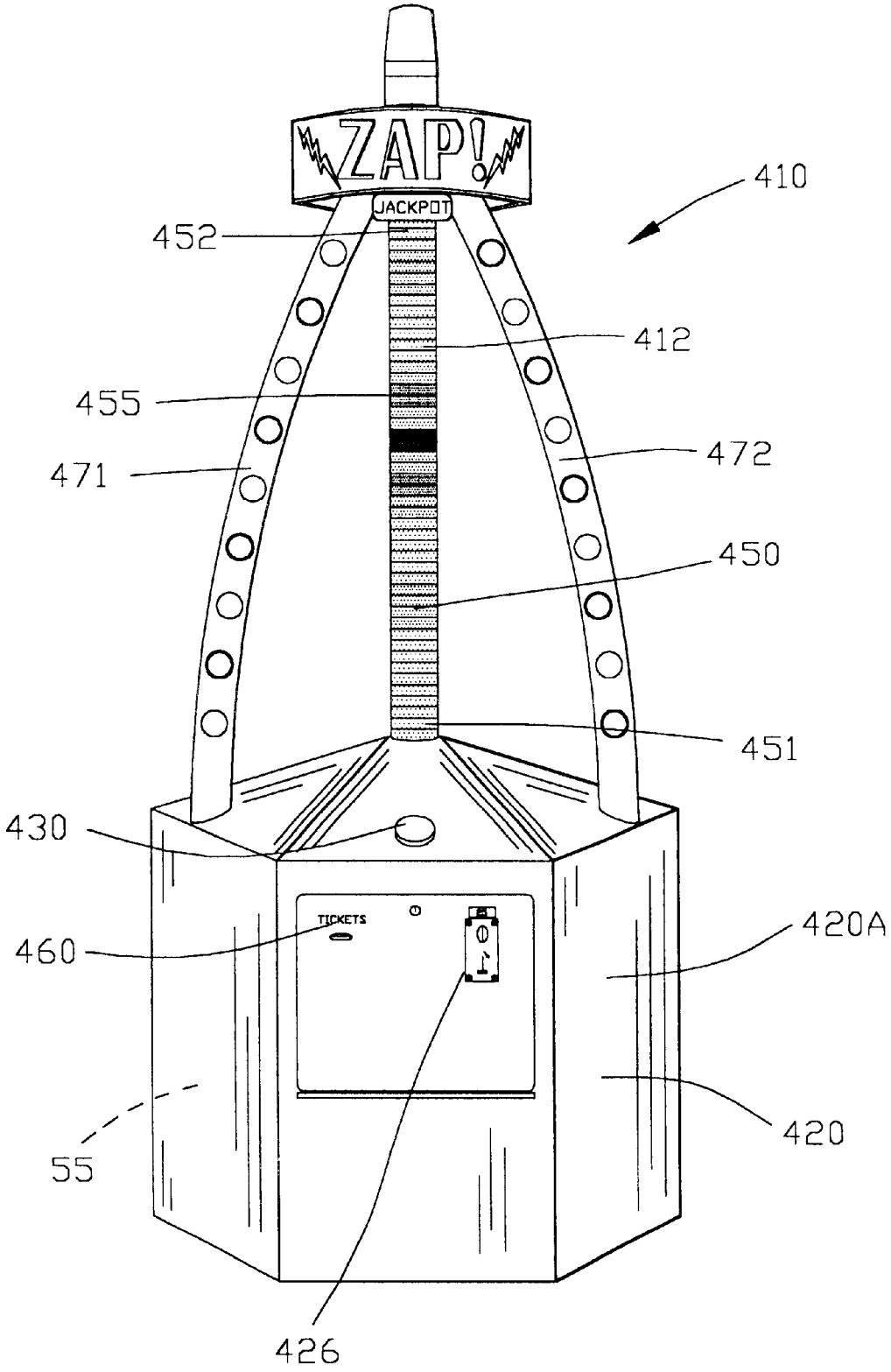
FIG. 19 illustrates a plurality of the illuminated longitudinally extending display incorporated into a fourth competitive game.

FIG. 19 illustrates an illuminated longitudinally extending display 412 incorporated into a fourth game 420. The fourth game 420 comprises a game console 420 having coin slot 426 for actuating the display device 450 incorporating the illuminated longitudinally extending display 412. The display device 450 extends between a lower end 451 and an upper end 452. The controller 55 reciprocates a band 455 between the lower end 451 and the upper end 452 of the display device 450. A contestant depresses button 430 to stop the reciprocation of a band 455 between the lower end 451 and the upper end 452 of the display device 450. The fourth game 420 dispenses tickets from a ticket slot 460 in accordance with the final level of the band 455 between the lower end 451 and the upper end 452 of the display device 450.

In an alternative example of the fourth game 420, the illuminated longitudinally extending display 412A may extend along a curved line. The illuminated longitudinally extending display 412A may be incorporated into the curved supports 471 and 472. It should be appreciated by those skilled in the art that the illuminated longitudinal extending display 412 of the present invention may be incorporated into various shapes and configurations.

Figure 20:
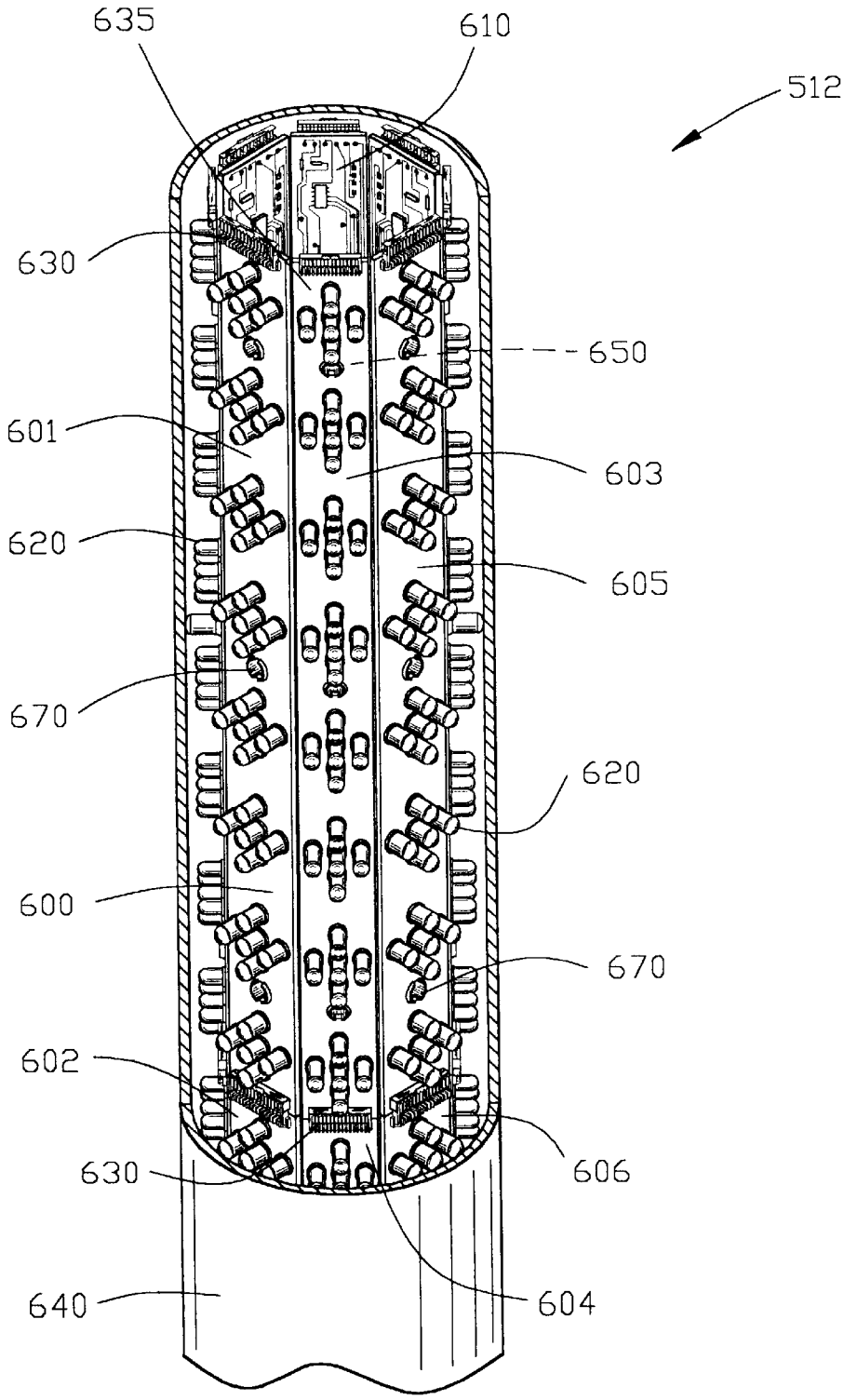
FIG. 20 is an isometric view of a portion of a second embodiment of illuminated longitudinally extending display.
Figure 21:
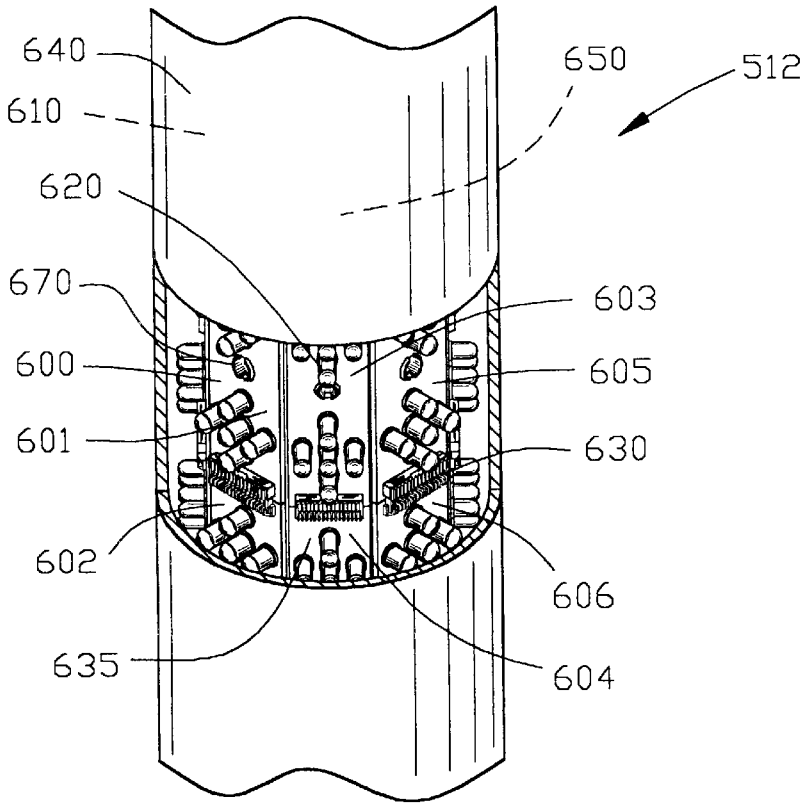
FIG. 21 is a magnified view of a portion of FIG. 20 illustrating a plurality of electrical connectors interconnecting a plurality of adjacent display segments.
Figure 22:
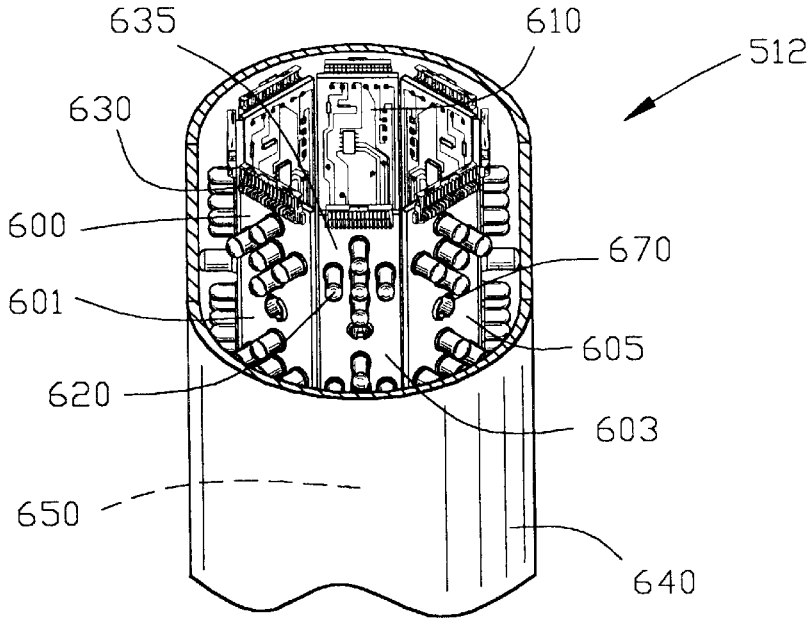
FIG. 22 is a view of a portion of FIG. 21 illustrating a plurality of electrical connectors.

FIGS. 20–22 illustrate various views of a portion of a second embodiment of illuminated longitudinally extending display 512. The illuminated longitudinal extending display 512 comprises a plurality of display segments 600 shown as display segments 601–606. In this example of the invention, each of the display segments 600 is a substantially planar circuit board 610 formed in a substantially rectangular configuration. A multiplicity of illuminated display elements 620 are disposed uniformly along each of said substantially rectangular circuit boards 610. Preferably, each of the multiplicity of illuminated display elements 620 comprises a solid state illumination device such as light emitting diodes.

A plurality of electrical connectors 630 interconnect the plurality of display segments 600 to form a longitudinal extending array 635 extending along a straight line. Preferably, each of the plurality of electrical connectors 630 electrically interconnect the plurality of display segments 600 to the electrical control 55. In the alternative, the plurality of electrical connectors 630 may interconnect the plurality of display segments 600 to form a longitudinal extending array 635 extending along a curved line (not shown).

A transparent tube 640 is shown disposed about the longitudinally extending array 635. The transparent tube 640 provides multiple reflection of the light output from the illuminated display elements 620 to further enhance the illuminated display. In addition, the transparent tube 640 provides protection for the electronic components of the illuminated longitudinal extending display 612 making the display suitable for use with a water actuated amusement game 20. The ends of the transparent tube 640 may be sealed to provide total protection for the electronic components of the illuminated longitudinal extending display 12.

Figure 24:
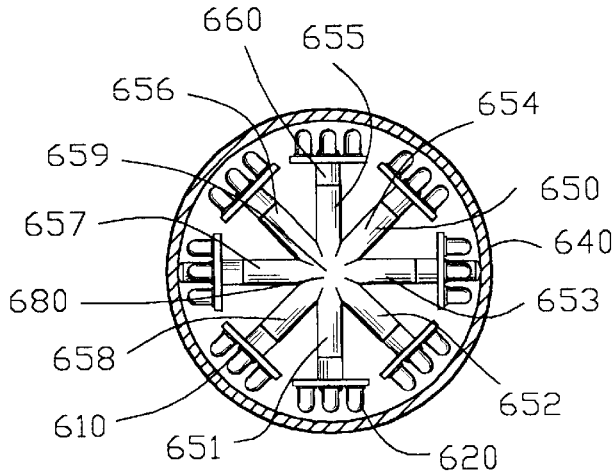
FIG. 24 is a sectional view along line 24—24 in FIG. 23.
Figure 23:
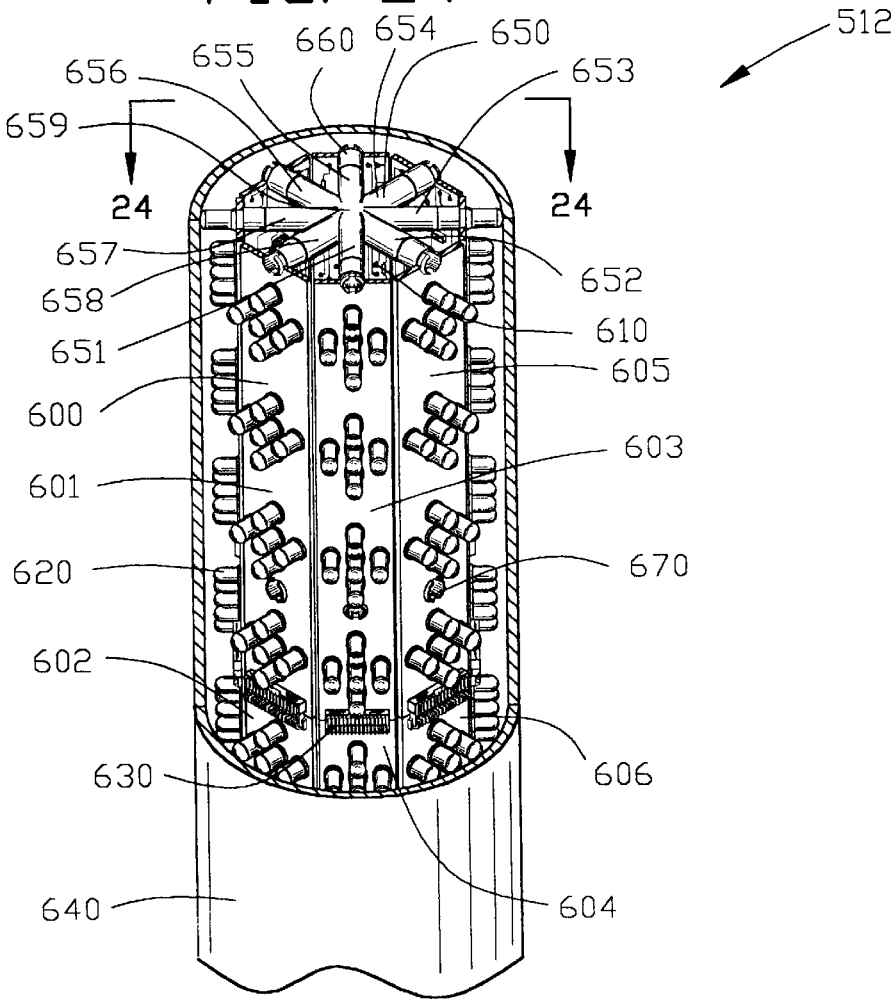
FIG. 23 is an isometric view of similar to FIG. 20 illustrating a support for the plurality of adjacent display segments.

FIGS. 23–24 are isometric and sectional views illustrating a support 650 for the plurality of adjacent display segments 600. Preferably, a plurality of supports 650 are incorporated for supporting the plurality of adjacent display segments 600. Each of the plurality of supports 650 comprises a plurality of arm 651–658 extending radially outwardly from a center 659. The distal ends of the plurality of arm 651–658 are provided with couplings 660 for engaging with apertures 670 located in the plurality of adjacent display segments 600. The plurality of display segments 600 are disposed about a cylindrical axis 680 extending through the centers 659 of the plurality of supports 650 for providing 360 degree illumination. The cylindrical axis 680 in a direction parallel to the longitudinal extending array 635. It should be appreciated by those skilled in the art that various means may be used for supporting the plurality of display segments 600.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved dynamic illuminated display, comprising:

a plurality of display segments;

a spacer interconnecting said plurality of display segments in a stacked relationship to form a longitudinal extending array;

each of said plurality of display segments having a multiplicity of illuminated display elements disposed about each of said plurality of display segments for providing substantially 360 degree illumination along said longitudinal extending array;

a controller connected to each of said multiplicity of illuminated display elements of said longitudinally extending array;

an input connected to said controller for providing an input signal to said controller for activating selected ones of said multiplicity of illuminated display elements in a desired sequence for providing a dynamic display to said longitudinally extending array; and a transparent tube disposed about said longitudinally extending array.

2. An improved dynamic illuminated display, comprising:

a plurality of display segments;

each of said display segments comprising a substantially planar circuit board having a multiplicity of illuminated display elements disposed about a periphery of said planar circuit board for providing 360 degree illumination;

said plurality of display segments being interconnected to form a longitudinal extending array with each of said plurality of display segments being disposed in an adjacent substantially parallel relationship;

a controller connected to each of said multiplicity of illuminated display elements of said longitudinally extending array; and an input connected to said controller for providing an input signal to said controller for activating selected ones of said multiplicity of illuminated display elements in a desired sequence for providing a dynamic display to said longitudinally extending array.

3. An improved dynamic illuminated display, comprising:

a plurality of display segments;

each of said display segments comprising a substantially planar circuit board having a multiplicity of illuminated display elements disposed about a periphery of said planar circuit board for providing 360 degree illumination;

said plurality of display segments being interconnected to form a longitudinal extending array with each of said planar circuit boards being disposed in an adjacent substantially parallel relationship and perpendicular to an axis extending through longitudinal extending array;

a controller connected to each of said multiplicity of illuminated display elements of said longitudinally extending array;

an input connected to said controller for providing an input signal to said controller for activating selected ones of said multiplicity of illuminated display elements in a desired sequence for providing a dynamic display to said longitudinally extending array; and a transparent tube disposed about said longitudinally extending array.

4. An improved dynamic illuminated display, comprising:

a plurality of display segments with each of said display segments comprising a planar circuit board having an outer periphery;

a plurality of spacers interconnecting said plurality of planar circuit boards in a stacked relationship to form a longitudinal extending array;

each of said plurality of planar circuit boards having a multiplicity of illuminated display elements disposed about said outer periphery of each of said plurality of planar circuit boards for providing substantially 360 degree illumination along said longitudinal extending array;

a controller connected to each of said multiplicity of illuminated display elements of said longitudinally extending array;

an input connected to said controller for providing an input signal to said controller for activating selected ones of said multiplicity of illuminated display elements in a desired sequence for providing a dynamic display to said longitudinally extending array; and a transparent tube disposed about said longitudinally extending array.

5. An improved dynamic illuminated display, comprising:

a plurality of display segments with each of said display segments comprising a planar circuit board having an outer periphery;

a plurality of spacers interconnecting said plurality of planar circuit boards in a stacked relationship to form a longitudinal extending array;

each of said plurality of planar circuit boards having a multiplicity of solid state illuminated display elements disposed about said outer periphery of each of said plurality of planar circuit boards for providing substantially 360 degree illumination along said longitudinal extending array;

a controller connected to each of said multiplicity of illuminated display elements of said longitudinally extending array; and an input connected to said controller for providing an input signal to said controller for activating selected ones of said multiplicity of illuminated display elements in a desired sequence for providing a dynamic display to said longitudinally extending array;

a transparent tube disposed about said longitudinally extending array.

6. An improved dynamic illuminated display, comprising:

a plurality of display segments with each of said display segments comprising a planar circuit board having a substantially circular outer periphery;

a plurality of spacers interconnecting said plurality of planar circuit boards in a stacked relationship to form a generally cylindrical longitudinal extending array;

each of said plurality of planar circuit boards having a multiplicity of solid state illuminated display elements disposed about said circular outer periphery of each of said plurality of planar circuit boards for providing substantially 360 degree illumination along said longitudinal extending array;

a controller connected to each of said multiplicity of illuminated display elements of said longitudinally extending array;

an input connected to said controller for providing an input signal to said controller for activating selected ones of said multiplicity of illuminated display elements in a desired sequence for providing a dynamic display to said longitudinally extending array; and a transparent tube disposed about said longitudinally extending array.

* * * * *